US006851406B2

(12) United States Patent
Santa Cruz et al.

(10) Patent No.: US 6,851,406 B2
(45) Date of Patent: Feb. 8, 2005

(54) CRANKSHAFT ACTUATED VEHICLE ACCESSORIES BELTLESS DRIVE APPARATUS

(76) Inventors: Cathy D. Santa Cruz, 7630 Tholl Dr., Reno, NV (US) 89506; Roger Hardy, 7630 Tholl Dr., Reno, NV (US) 89506

( * ) Notice: Subject to any disclaimer, the term of this patent is extended or adjusted under 35 U.S.C. 154(b) by 1 day.

(21) Appl. No.: 10/281,705

(22) Filed: Oct. 28, 2002

(65) Prior Publication Data

US 2004/0079312 A1 Apr. 29, 2004

(51) Int. Cl.[7] ..... F02M 35/10

(52) U.S. Cl. ..... 123/184.21; 123/198 R

(58) Field of Search ..... 123/184.21, 198 R

(56) References Cited

U.S. PATENT DOCUMENTS 5,704,331 A * 1/1998 Eberbach et al. ..... 123/198 R

* cited by examiner

*Primary Examiner*—Henry C. Yuen
*Assistant Examiner*—Katrina B. Harris

(57) ABSTRACT

A manifold which when mounted onto an engine block and its associated crankshaft in line with other rotating accessories of an internal combustion engine, provides a more compact and efficient arrangement of such accessories. Also, the apparatus eliminates parts, such as the belt drive and distributor, and greatly improves overall performance.

6 Claims, 3 Drawing Sheets

CRANKSHAFT ACTUATED VEHICLE ACCESSORIES BELTLESS DRIVE APPARATUS

FIELD OF THE INVENTION

The present invention relates to devices used in connection with a typical combustion engines crankshaft. But more particularly pertains to a manifold which when mounted onto an engine block and its associated crankshaft in line with other rotating accessories of an internal combustion engine, provides a more compact arrangement of such accessories. Also, the apparatus eliminates parts, such as the belt drive and distributor, and greatly improves overall performance.

BACKGROUND OF THE INVENTION

Internal combustion engines typically drive several accessories through a belt drive arrangement that is normally powered by the engine's crankshaft or camshaft. For example, such accessories may include an alternator, a distributor, an air conditioning compressor, a power steering pump, oil pump, etc.

However, such belt drive systems are totally dependant upon the drive belt and also such systems as typically arranged are not at all compact. Thus a large amount of engine space must be utilized which is a major concern, as space is very limited within today's engine compartments. Also, it would be advantageous if the accessories were not dependant upon a drive belt, as such drive belts continuously tend to easily break due to excessive wear and tear.

Upon conducting a thorough search within the known prior art, the applicants did not find any apparatus which functions in the manner as herein described and taught. Nor did we find any apparatus which would be applicable for use, as is the present invention.

SUMMARY OF THE INVENTION

It is therefore an object of the present invention to provide an apparatus for controlling various vehicle accessories without the need for a belt drive system.

It is another object of the present invention to provide an apparatus for controlling various vehicle accessories which can be easily mounted onto the engine block and associated crankshaft of any typical combustion engine.

Yet another object of the present invention is to provide an apparatus for controlling various vehicle accessories which may be in the form of a manifold for housing the various accessories.

Still another object of the present invention is to provide an apparatus for controlling various vehicle accessories which includes such accessories as, but not limited too, a flying magnet alternator, a centrifugal oil filter, a crank triggered ignition, a gear rotor oil pump, etc.

Yet another object of the present invention is to provide an apparatus for controlling various vehicle accessories which eliminates parts normally associated with such accessories, such as the typical alternator, typical distributor, typical water pump, typical oil filter with oil pump, etc.

Also another important object of the present invention is to provide an apparatus for controlling various vehicle accessories which is substantially a retrofit, as it can be easily mounted and installed onto any typical combustion engine having a crankshaft without the need for any specialized tools.

Still a further object of the present invention is to provide an apparatus for controlling various vehicle accessories which can be sold as a kit, including installation instructions that any normal skilled mechanic will readily understand.

A further object of the present invention is to provide an apparatus for controlling various vehicle accessories which is economical to produce and affordable for the consumer.

Other objects and advantages will be seen when taken into consideration with the following specification and drawings.

DETAILED DESCRIPTION OF THE DRAWINGS

Figure 1:
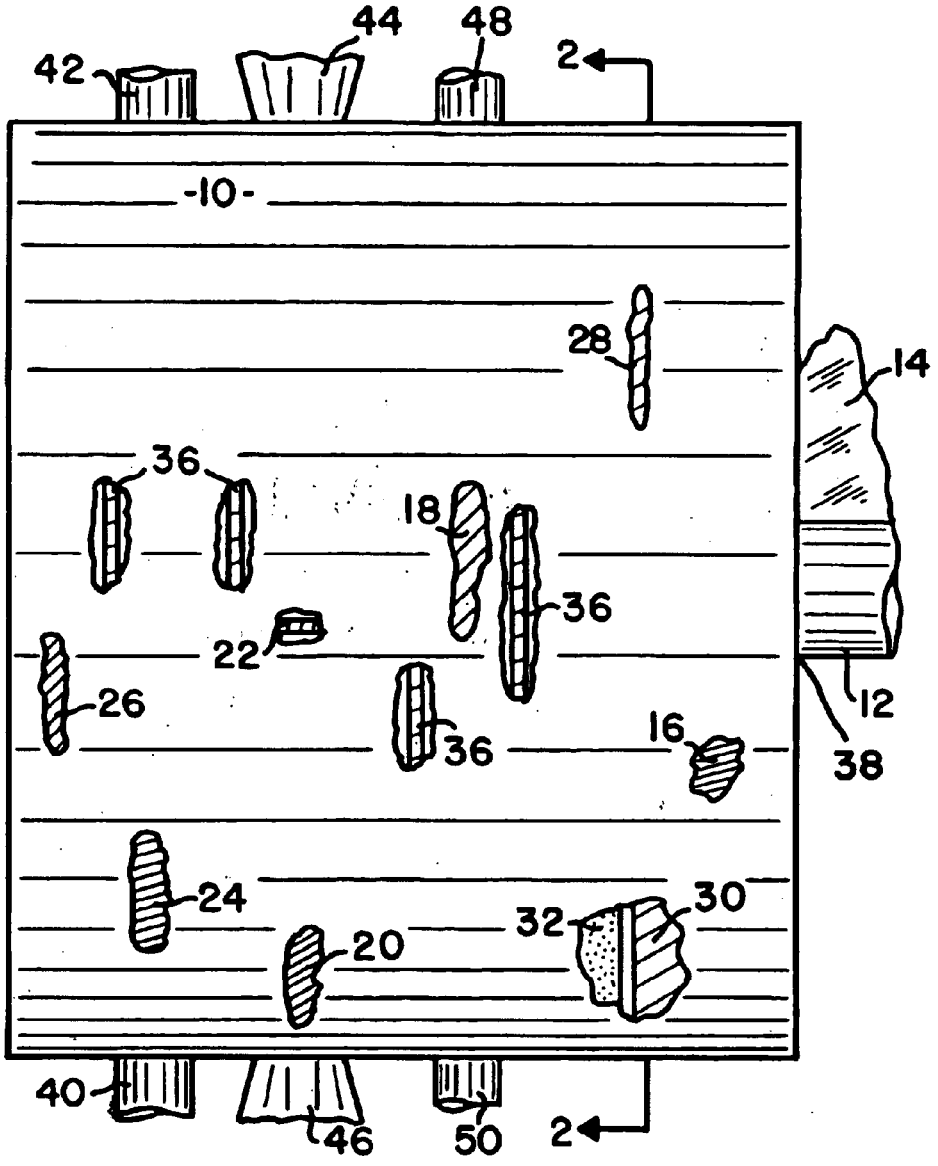
FIG. 1 is substantially a side, plan view of a manifold when mounted onto the engine block and associated crankshaft of a typical combustion engine, with the manifold housing various vehicle accessory drive components which are shown by partial cut-a-ways.
Figure 2:
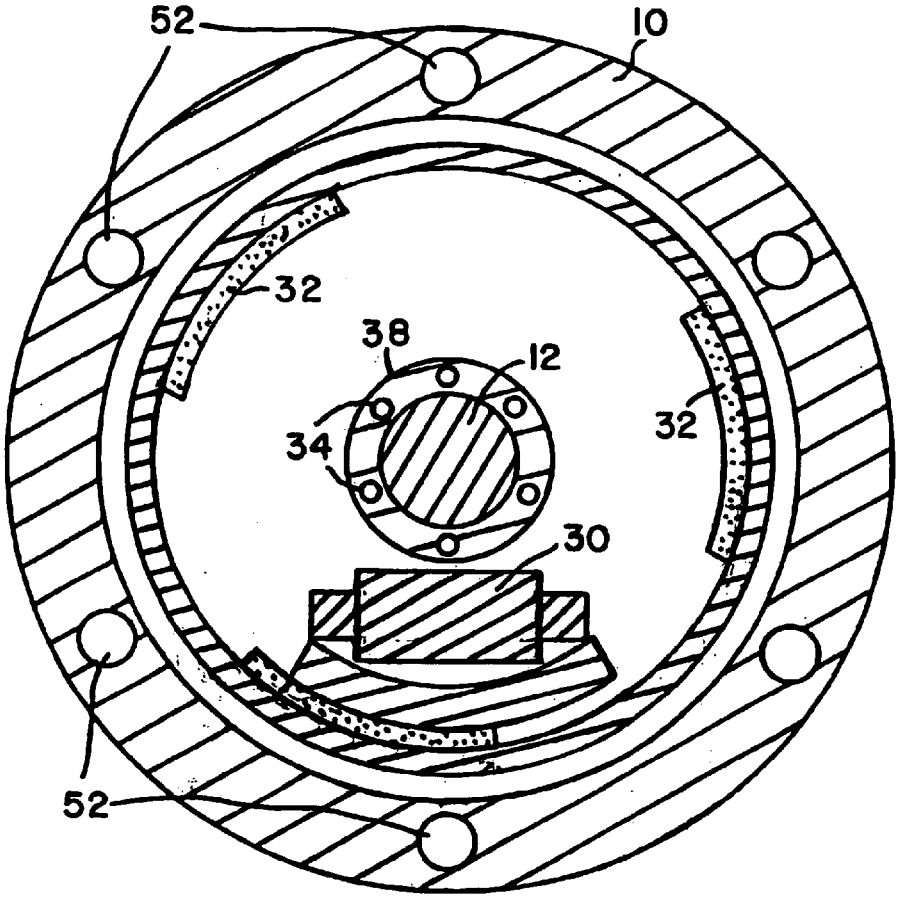
FIG. 2 is substantially a sectional view taken at 2—2 of FIG. 1 and partially depicts the noted manifold when mounted onto the engine block and associated crankshaft of a typical combustion engine and which further illustrates an internal flying magnet alternator and its components.
Figure 3:
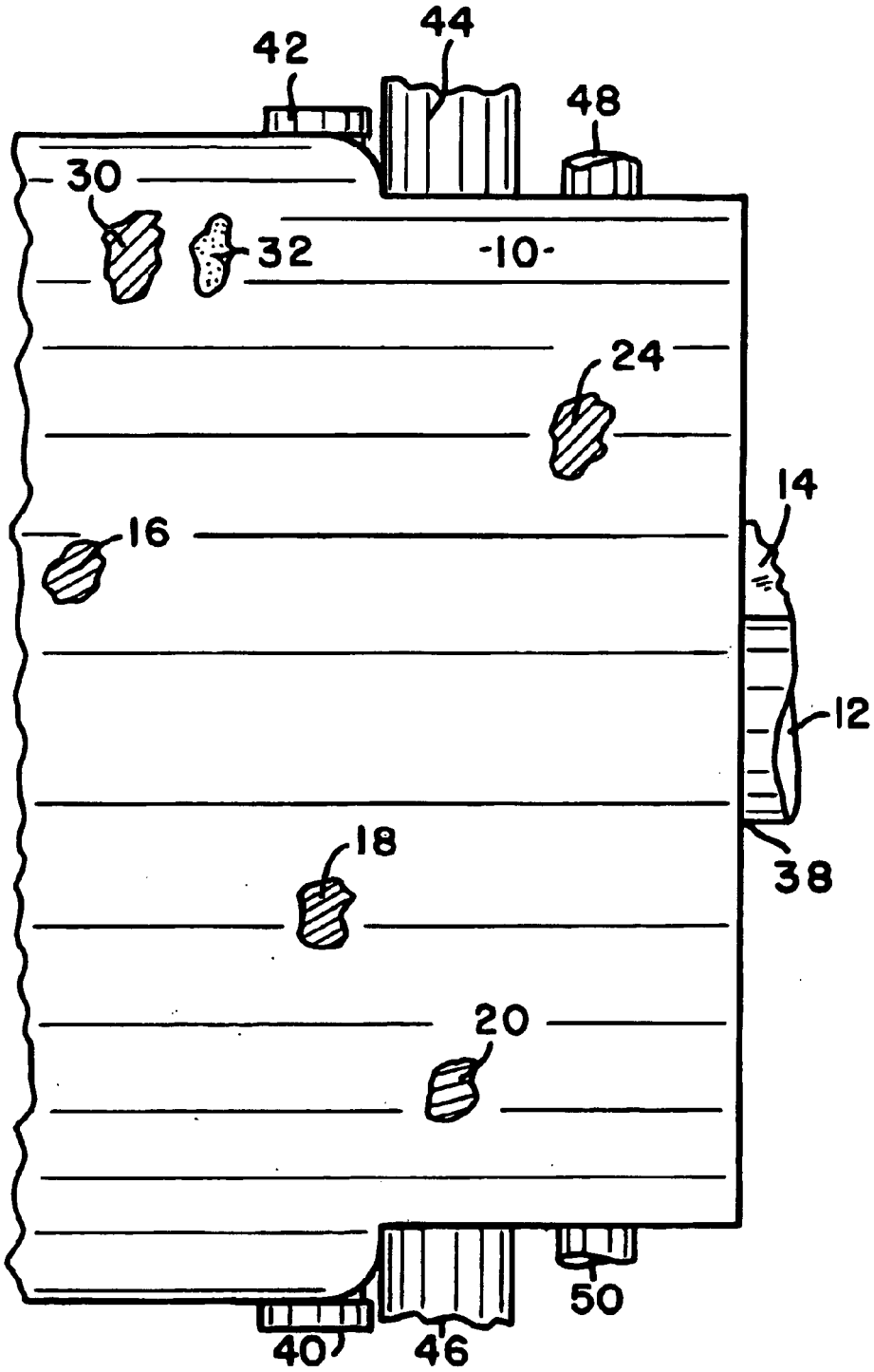
FIG. 3 is substantially a side, plan view of a different arrangement for the manifold when mounted onto the engine block and associated crankshaft of a typical combustion engine, with the manifold housing various vehicle accessory drive components that are shown by partial cut-a-ways.

Referring now in detail to the drawings wherein like characters refer to like elements throughout the various views. As depicted in FIGS. 1 & 2, the present invention substantially comprises a manifold (10) which is of a shape and size to be fixedly mounted and attached onto an engine block (14) of a typical internal combustion engine, and manifold (10) includes a central elongated opening (38) therein for receiving a crankshaft (12), which is normally associated with the noted typical internal combustion engine, respectively. If needed, crankshaft (12) may be extended by use of an extension member which is fixedly attached onto crankshaft (12) by any suitable attachment means of engineering choice, such as by bolts or the like.

It is to be understood that manifold (10) can be made from substantially any suitable material of engineering choice, such as steel, aluminum, or the like. Also manifold (10) may be fixedly mounted onto the engine block (14) by any appropriate mounting means of engineering choice, such as by typical mounting bolts (not shown) and mounting holes (52), or the like.

Manifold (10) further being compartmented for housing various internal vehicle accessory drive components, and crankshaft (12) providing rotational force for rotational centrifugal operation of the various internal vehicle accessory drive components. It is to be understood a multitude of various vehicle accessory drive components can be used depending on engineering choice. Thus the following are only exemplary of some suitable vehicle accessory drive components. Namely, a crank triggered ignition (16), a gear rotor oil pump (18), a water pump (20) with internal impellers (22), a centrifugal oil filter (24), a harmonic balancer (26), at least one coil (30) and at least one rotating magnet (32).

It is to be further understood that that the noted at least one coil (30) with the noted at least one rotating magnet (32) in combination create electricity and function as a flying magnet alternator, such as more clearly shown in FIG. 2. Also, the mounting bolts (34) as depicted therein, may be used as electrical pickups of so desired.

It shall be further understood that each of the various internal vehicle accessory drive components may be easily separated from each other by any appropriate sealing means, such as by sealing rings (36) or the like. Again, sealing rings (36) may be made from any suitable material of engineering choice, such as rubber or the like, but it is preferable that the material be very strong so as to be durable and resist wear when subjected to friction.

Manifold (10) further includes a first oil inlet port (40), a first oil outlet port (42), a water inlet port (44), a water outlet port (46), a second oil inlet port (48) and a second oil outlet port (50). With the first oil inlet port (40) and the first oil outlet port (42) being substantially opposed to each other and in combination allow oil to flow into and throughout gear rotor oil pump (18). Water inlet port (44) and water outlet port (46) are opposed to each other and in combination allow water to flow into and throughout water pump (20), and second oil inlet port (48) and second oil outlet port (50) are opposed to each other and in combination allow oil to flow into and throughout centrifugal oil filter (24).

It can now be seen, that we have herein provided a novel apparatus which teaches a manifold that can be easily fixedly attached onto an engine block of a typical combustion engine, or it can be utilized for use with an outboard motor, or the like. With the manifold having internal vehicle accessory drive components which are actuated by rotational centrifugal force provided by the rotating crankshaft. The apparatus is of simple construction, economical and affordable to produce and thus provides unusual end results which have not previously been achieved within the known prior art.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatus's.

Having described our invention, what we claim as new and wish to secure by Letters Patent is:

1. A crankshaft actuated vehicle accessories belt-less drive apparatus comprising: a manifold which is fixedly mounted onto an engine block of a typical internal combustion engine, said manifold having a central elongated opening therein for receiving a crankshaft associated with said typical internal combustion engine, said manifold housing various internal vehicle accessory drive components, and said crankshaft providing rotational force for rotational centrifugal operation of said various internal vehicle accessory drive components.

2. The crankshaft actuated vehicle accessories belt-less drive apparatus of claim 1 wherein said various internal vehicle accessory drive components include but are not limited too, a crank triggered ignition, a gear rotor oil pump, a water pump with internal impellers, a centrifugal oil filter, a harmonic balancer, an arrangement of at least one coil and at least one rotating magnet which create electricity, and said at least one coil with said at least one rotating magnet in combination function as a flying magnet alternator.

3. The crankshaft actuated vehicle accessories belt-less drive apparatus of claim 2 wherein said flying magnet alternator includes mounting bolts which function as electrical pickups.

4. The crankshaft actuated vehicle accessories belt-less drive apparatus of claim 1 wherein said various internal vehicle accessory drive components are separated from each other by appropriate sealing rings.

5. The crankshaft actuated vehicle accessories belt-less drive apparatus of claim 1 wherein said manifold further provides a first oil inlet port; a first oil outlet port; a water inlet port; a water outlet port; a second oil inlet port and a second oil outlet port.

6. The crankshaft actuated vehicle accessories belt-less drive apparatus of claim 5 wherein said first oil inlet port and said first oil outlet port are opposed to each other and in combination allow oil to flow into and throughout a gear rotor oil pump, said water inlet port and said water outlet port are opposed to each other and in combination allow water to flow into and throughout a water pump, said second oil inlet port and said second oil outlet port being opposed to each other and in combination allow oil to flow into and throughout a centrifugal oil filter.

* * * * *